US005518376A

United States Patent [19]

Haraoka

[11] Patent Number: 5,518,376

[45] Date of Patent: May 21, 1996

[54] COMBINED HOUSING AND AIR PUMP

[76] Inventor: Akira Haraoka, 5-19 Minami 2-chome, Meguro-ku, Tokyo 152, Japan

[21] Appl. No.: 189,766

[22] Filed: Feb. 1, 1994

[51] Int. Cl.[6] ..... F04B 19/02

[52] U.S. Cl. ..... 417/437; 417/469; 417/571

[58] Field of Search ..... 417/437, 451, 417/454, 469, 571; 92/66, 75, 117 R

[56] References Cited

U.S. PATENT DOCUMENTS 5,071,325 12/1991 Tupper et al. ..... 417/571

FOREIGN PATENT DOCUMENTS 1002212 2/1957 Germany ..... 417/437
2141490 12/1984 United Kingdom ..... 417/469

*Primary Examiner*—Charles Freay
*Attorney, Agent, or Firm*—Burns, Doane, Swecker & Mathis

[57] ABSTRACT

A combined housing and air pump has a barrel type outside vessel one end of which is closed and the other end of which is open, a barrel type inside vessel one end of which is closed and the other end of which is open, and an air suction opening and an air discharge opening formed on the closed end of one of the outside vessel and the inside vessel, the inside vessel can be inserted from the opening of the outside vessel, and inside the outside vessel the outer periphery of the inside vessel is substantially very close to the inner periphery of the outside vessel and the inside vessel can rub in the axial direction of these vessels. The air suction opening has a check valve through which an air is allowed to pass only in the air suction direction, and the air discharge opening has removable nozzle separately formed. The container can be carried with things contained in the inside space sectioned by the two vessels. And the container can be used as an air pump to inflate a balloon and so on by taking the inside vessel in and out of the outside vessel in the axial direction. It is convenient not to have to carry an air pump separately.

9 Claims, 8 Drawing Sheets

COMBINED HOUSING AND AIR PUMP

BACKGROUND OF THE INVENTION

1. Field of the Invention

The present invention relates to a combined housing and air pump, in other words, a container having an air pump function employed to fill an air cushion and a tire and so on with an air.

1. Prior Art Description

An air cushion and a tire and so on are generally blown up by a man directly. Recently, however, playthings such as an oversized tire have been used, and a cornice-shaped or a bellows-shaped air pump has been employed to inflate them.

Air pumps generally used, however, are bulky and are not handy to carry.

Taking the above-mentioned problem into consideration, the object of the present invention lies in proposing a container also serving as an air pump which is handy to carry.

SUMMARY OF THE INVENTION

To achieve the above-mentioned object, a combined housing and air pump according to the present invention has a barrel type outside vessel one end of which is closed and the other end of which is open, a barrel type inside vessel one end of which is closed and the other end of which is open, and an air suction opening and an air discharge opening formed on a closed end of either the above-mentioned outside vessel or the inside vessel, the before-mentioned inside vessel can be inserted through the aperture of the above-mentioned outside vessel, and inside the outside vessel, the outer periphery of the above-mentioned inside vessel is substantially very close to the inner periphery of the outside vessel and can slide toward the axial direction of these vessels.

In the combined housing and air pump constituted in this way, the inside space formed by fitting the inside vessel into the outside vessel can be used as a containing space. By reciprocating the inside vessel in the axial direction inside the outside vessel, an air is sucked into the inside space through the air suction opening formed in one of the vessels and the inside air is discharged through the air discharge opening. That is, when the inside vessel is drawn from inside the outside vessel, an air is sucked into the inside space from the outside through the air suction opening. Conversely, when the inside vessel is pushed in the outside vessel, an air is discharged outside through the air discharge opening. Accordingly, by reciprocating the inside vessel with the air discharge opening put on an air intake of a tire and so on, the tire and so on can be inflated.

It is preferred to place in the above-mentioned air suction opening a check valve through which an air is allowed to pass only in the air suction direction. If constituted in this way, there is no need to close the air suction opening with a finger and so on in the air discharge operation.

It is also preferred to assemble an air discharge nozzle to the before-mentioned air discharge opening removably. Then, an air filling operation can be performed efficiently by introducing the nozzle into an air intake of a tire and so on.

In a suitable practice of the present invention, the before-mentioned air suction opening and the before-mentioned air discharge opening are formed on the closed end of the above-mentioned outside vessel, the inside vessel is inserted into the outside vessel from the closed end side, a cover which can close an open end of the outside vessel is assembled removably to the open end, and the cover can be assembled removably to an open end of the inside vessel. In this constitution, since the cover can be removed easily, towels, clothing and so on can be easily put in the vessel, and these can be easily taken out from the vessel.

It is possible, for instance, to make a bottle of shampoo and so on separable into top and bottom, and to separate the bottle into top and bottom after the inside shampoo is used to make them serve as the outside vessel and the inside vessel.

A combined housing and air pump according to another embodiment of the present invention has a container main body equipped with an aperture which can be sealed at least in a part of it, an elastic portion which can be elastically deformed formed at least in a part of the container main body, and an air suction opening and an air discharge opening formed in the container main body.

In this system, towels and so on can be put inside after opening the aperture. And a pumping can be performed by elastically deforming the elastic portion with the aperture sealed.

It is possible to make the container main body a barrel type container, and to form an elastic portion which can be elastically deformed in the axial direction of the container on the peripheral side of the barrel type container. Or it is possible to form an elastic portion which can be elastically deformed in the direction cutting the axial direction of the container at right angles on the peripheral side of the barrel type container.

It is preferred to place in the above-mentioned air suction opening a check valve through which an air is allowed to pass only in the air suction direction. It is also preferred to assemble an air discharge nozzle to the before-mentioned air discharge opening removably.

On the other hand, the container main body can be a rectangular parallelopiped as a whole. In this case, it is necessary to form at least in a part of a side of the container the elastic portion which can be elastically deformed in the direction cutting the side at right angles.

Furthermore, it is possible to compose the container main body of a flexible material and a leaf spring member holding the flexible material in the preset shape, and to constitute the container main body in an elastically deformable way against the spring force of the leaf spring member.

DETAILED DESCRIPTION OF PREFERRED EMBODIMENTS

EMBODIMENT 1

Figure 1:
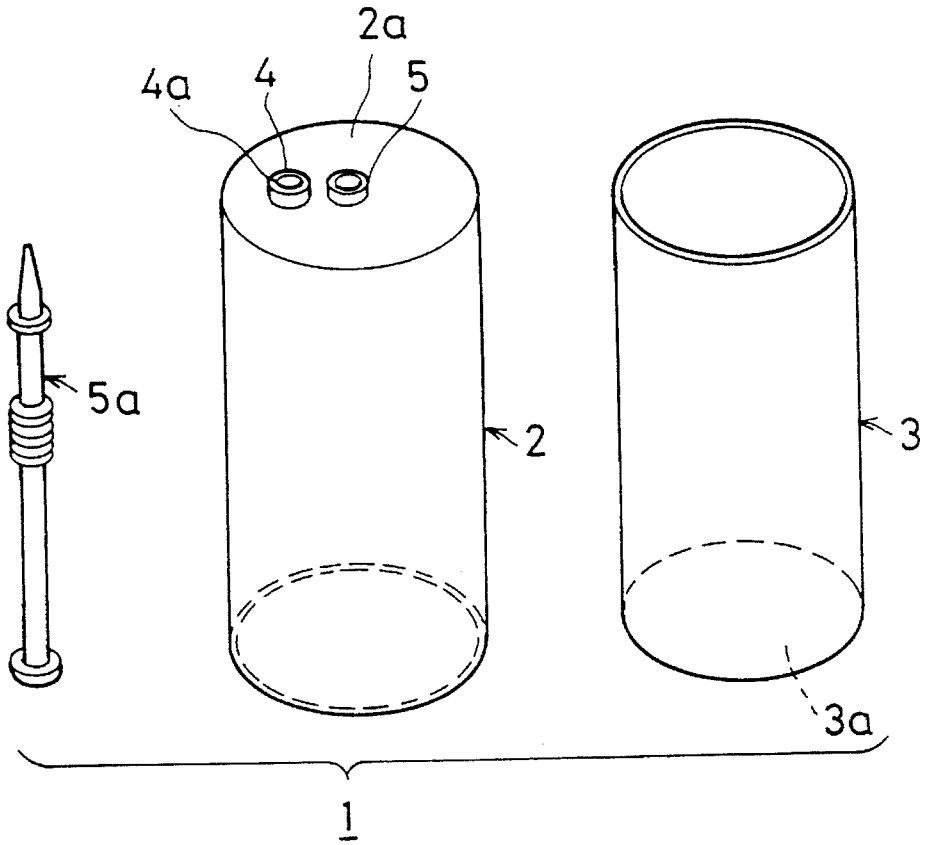
FIG. 1 is an exploded perspective view of a container in Embodiment 1 according to the present invention.

FIGS. 1 to 4 illustrate the first embodiment according to the present invention. A container 1 in this embodiment is composed of barrel type outside vessel 2 and an inside vessel 3 which can be inserted inside the outside vessel in such a way that it is intimately slidable in the outside vessel. The outside vessel 2 and the inside vessel 3 are both barrel-shaped, and one end of them are bases 2*a* and 3*a* which are closed.

These vessels 2 and 3 are molded from synthetic resin of the fixed thickness. On the base 2*a* of the outside vessel 2, an air suction opening 4 and an discharge opening 5 are formed. In the suction opening 4, a check valve 4*a* allowing an air to pass only to the inside of the vessel is set. In the discharge opening 5, a discharge nozzle 5*a* separately formed is placed removably.

Figure 2:
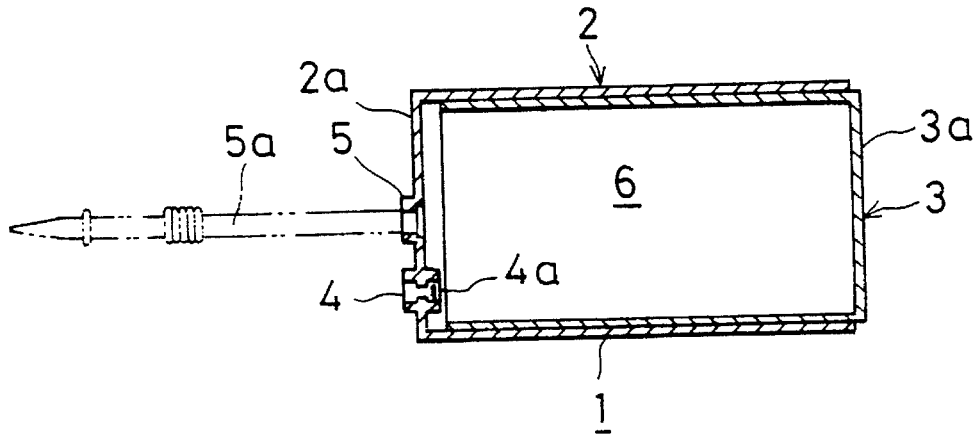
FIG. 2 is a longitudinal section of the container in FIG. 1.

The container 1 in this embodiment, as shown in FIG. 2, is employed by inserting the inside vessel 3 from an open side of the outside vessel 2. That is, an air cushion and so on to be inflated by the container 1 are contained in a hollow portion 6 defined by the vessels 2 and 3. The container 1 is carried in this condition.

Figure 3:
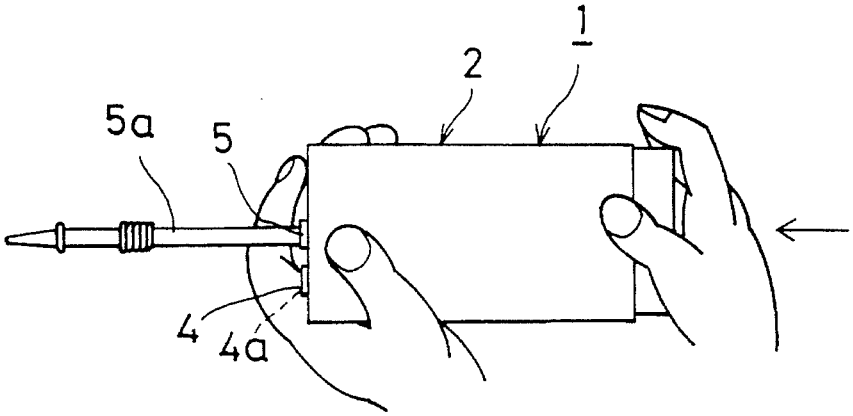
FIG. 3 illustrates the container in FIG. 1 when it is employed as an air pump.
Figure 4:
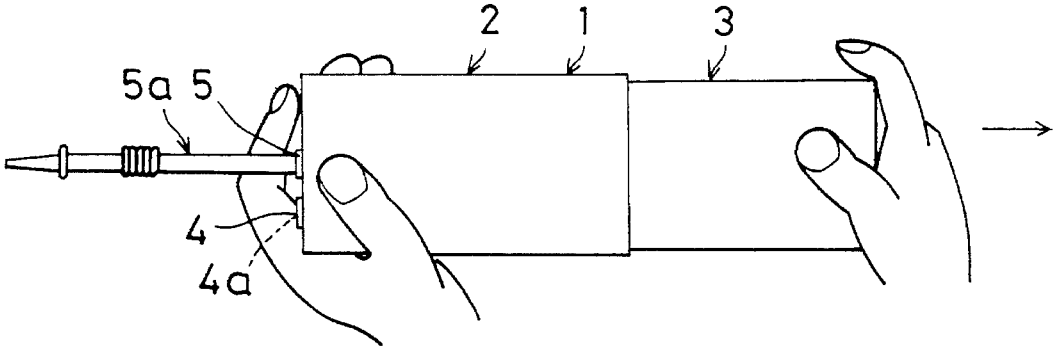
FIG. 4 illustrates the container in FIG. 1 when it is employed as an air pump.

The container 1 in this embodiment is used as an air pump in the following way. The hollow portion 6 is emptied, and the nozzle 5*a* is assembled to the discharge opening 5. Then the nozzle 5*a* is inserted into an air intake (not illustrated) of an air cushion and so on. In this condition, as shown in FIGS. 3 and 4, the inside vessel 3 is reciprocated in the axial direction to the outside vessel 2. As shown in FIG. 4, when the inside vessel 3 is drawn out, the hollow portion 6 is filled with an air through the suction opening 4. Subsequently, as shown in FIG. 3, when the inside vessel 3 is pushed in, the air in the hollow portion 6 is packed in the air cushion through the discharge opening 5 and the nozzle 5*a*. Since the suction opening 4 has the check valve 4*a*, the air is not discharged from the suction opening 4.

Thus the container 1 in this embodiment can be usually employed as a container. And the container 1 can be used as an air pump when necessary. Accordingly, is not necessary to carry an air pump in addition as usual.

Figure 5:
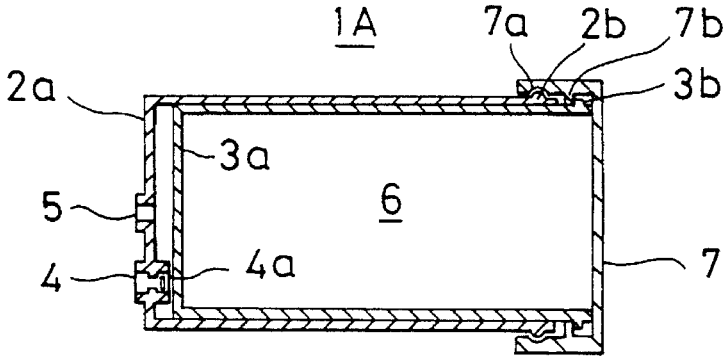
FIG. 5 is a longitudinal section of a modified embodiment of the container in FIG. 1.
Figure 6:
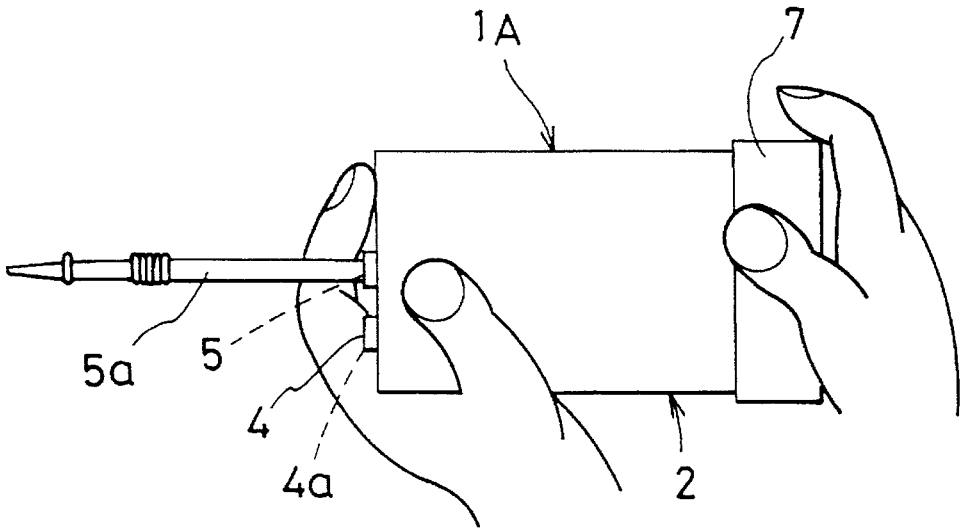
FIG. 6 illustrates the container in FIG. 5 when it is employed as an air pump.

FIGS. 5 and 6 illustrate a modified embodiment of the above-mentioned embodiment. In these drawings, the same number is used for the part corresponding to each part of the before-mentioned container 1. In a container 1A in this embodiment, an inside vessel 3 is inserted in an outside vessel 2 in such a way that the bases are on the same side. A ring projection 2*b* is formed on the outer periphery of the open side of the outside vessel 2. A ring groove 7*a* into which the projection 2*b* is fitted is formed on the inner periphery of a cover 7 to seal the opening of the outside vessel. A ring projection 3*b* is formed on the outer periphery on the open side of the inside vessel 3, and a ring projection 7*b* which can engage with the projection 3*b* is formed on the inner periphery of the cover 7.

The container 1A constituted in this way is convenient in that things to be contained can be put in and out from the hollow portion 6 by lifting the cover 7 without drawing the inside vessel 3 from the outside vessel 2. A pumping operation can be carried out as in the above-mentioned container 1, and as shown in FIG. 6, the inside vessel 3 is reciprocated in the axial direction with the cover 7 set on the open side of the inside vessel 3.

Note that although the before-mentioned containers and 1A are barrel-shaped, they can have other shapes. For instance, they can be barrel-shaped with an elliptic section or a polygonal section. The suction opening 4 and the discharge opening 5 can be formed either in the outside vessel 2 or in the inside vessel 3. Furthermore, there can be more than one suction openings and discharge openings. And the nozzle 5*a* can be integrally formed with the discharge opening.

Although the before-mentioned containers 1 and 1A have the check valve in the suction opening, it can be omitted. In this case, the suction opening can be sealed with a finger and so on when an air is discharged. It is preferred to prevent a back flow of the air going from the discharge opening to the inside by placing a check valve in the discharge opening 5 when a balloon and so on are filled with a compressed air.

Figure 7:
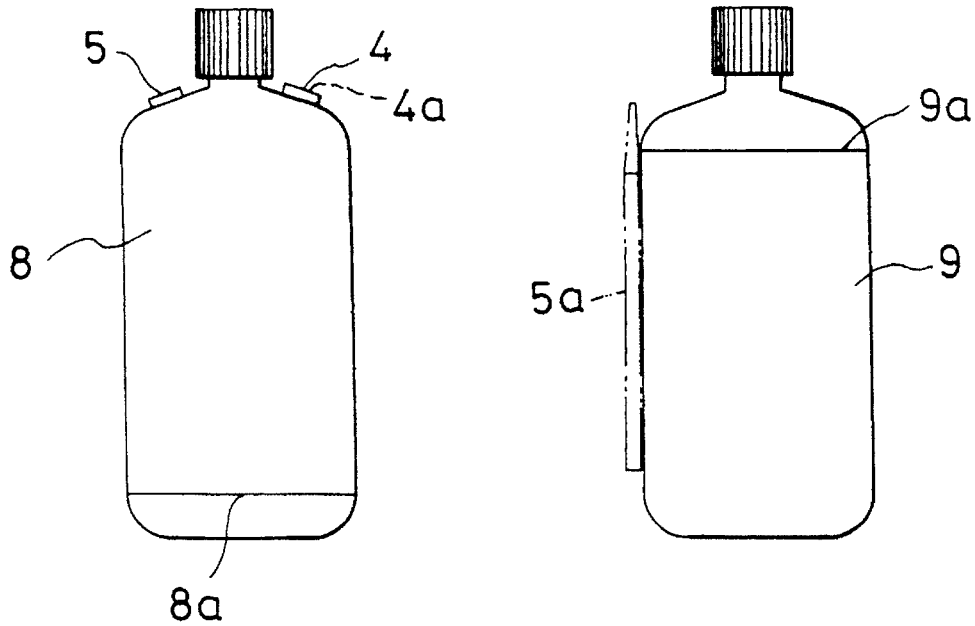
FIG. 7 is a side view of a modified embodiment of the container in FIG. 1.

In the above-mentioned two embodiments, the inside vessel 3 is inserted in the outside vessel 2. Instead, as shown in FIG. 7, the container in this embodiment can be composed of two bottles 8 and 9. As shown in the drawing, for example, one bottle 8 is a shampoo bottle and the other bottle 9 is a rinse bottle. The bottle 8 has a suction opening 4 and a discharge opening 5, and the suction opening 4 has a check valve 4*a*. And there is a light-gage section portion 8*a* which can be cut formed on the periphery of the base. The other bottle 9 has a light-gage section portion 9*a* which can be cut on the periphery of the aperture side.

After the content is used, the bottles 8 and 9 are cut at the respective light-gage section portions 8*a* and 9*a* to form the outside vessel and the inside vessel. And by inserting the inside vessel into the outside vessel, a container functioning similarly to the before-mentioned containers 1 and 1A can be formed.

EMBODIMENT 2

Figure 8:
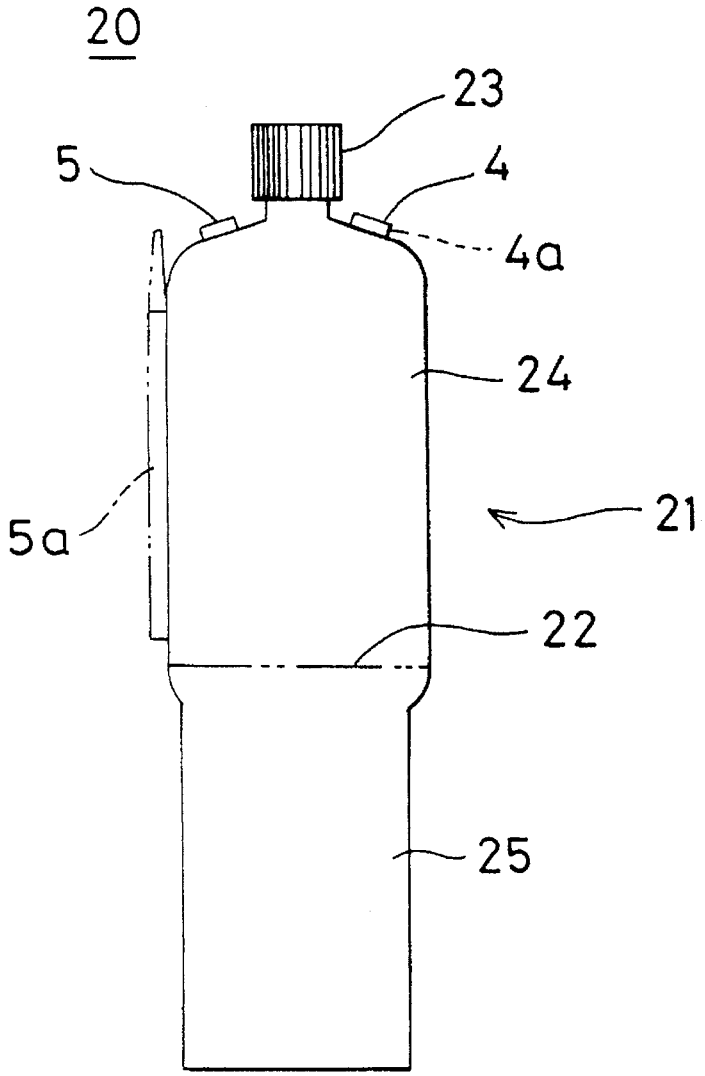
FIG. 8 is a side view of the container in Embodiment 2 according to the present invention.

FIG. 8 illustrates the second embodiment according to the present invention. A container 20 in this embodiment is composed of a bottle of mineral water and so on. That is, there is a cuttable portion 22 separable into top and bottom formed on the outer periphery in the center of a bottle main body 21. And there are a suction opening 4 and a discharge opening 5 formed on the outer periphery near a mouth 23 of the bottle main body 21, and the suction opening 4 has a check valve 4*a*. The part below the cuttable portion 22 has a smaller diameter than the part above the cuttable portion 22.

After the bottle main body 21 is separated into top and bottom, the upper half forms an outside vessel 24 and the lower half forms an inside vessel 25. The container 20 according to the present invention can be constituted by inserting the inside vessel 25 into the outside vessel 24. It is possible to assemble a nozzle 5*a* to the outside vessel 24.

EMBODIMENT 3

Figure 9:
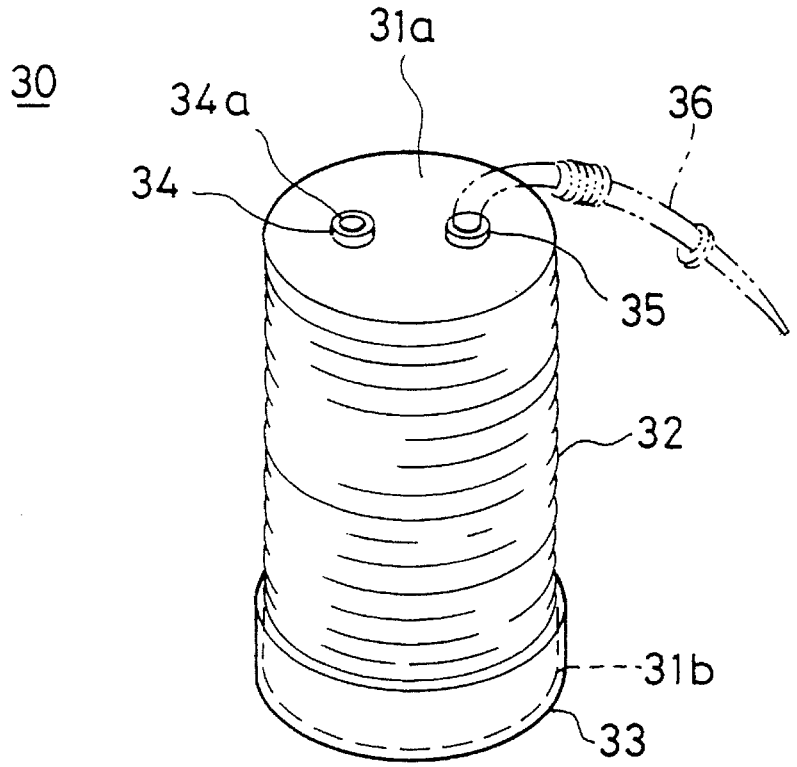
FIG. 9 is a perspective view of the container in Embodiment 3 according to the present invention.

FIG. 9 illustrates the third embodiment according to the present invention. A container 30 in this embodiment is composed of a barrel type container main body 32 one end of which is a base 31*a* and the other end of which is an opening 31*b*, and a cover 33 assembled to the opening 31*b* of the container main body 32. The base 31*a* has an air suction opening 34 and an air discharge opening 35, and the air suction opening 34 has a check valve 34*a*. The periphery of the container main body 32 has a bellows structure, and can be expanded and contracted in its axial direction. In this embodiment, the periphery of the container main body 32 is made from synthetic resin having elastic characteristics, and after the periphery is crushed in the axial direction from the state illustrated in the drawing and the press force is removed, it returns to the state shown in the drawing by its own elastic return force. Furthermore, a separately formed nozzle 36 can be placed removably in the discharge opening 35.

Things to be contained can be taken in and out of the container 30 in this embodiment by opening and closing the cover 33. When the container is used as an air pump, the inside is emptied and the nozzle 36 is assembled to the discharge opening 35. In this condition, the container main body 32 is expanded and contracted in the axial direction. The expansion and contraction operation sucks an air inside through the suction opening 34, and the sucked air is discharged from the discharge opening 35. When it is required to pack a compressed air as in the case of a balloon, it is preferable to assemble a check valve to the discharge opening 35 in order to prevent the back flow of the air from the discharge opening 35.

Note that in this embodiment the elastic return force can be improved by assembling a coiled spring and so on to the bellows-structured periphery. It is convenient to use a coiled spring and so on, because then there is no need to employ materials having elastic characteristics as a material of the periphery of the container main body 32.

The suction opening and the discharge opening can be formed on the cover 33. Furthermore, it is possible to make more than one suction openings and discharge openings. And the nozzle 36 can be formed integrally with the discharge opening 35.

The check valve assembled to the suction opening can be omitted. In this case, the suction opening can be sealed by a finger and so on in pumping.

EMBODIMENT 4

Figure 10:
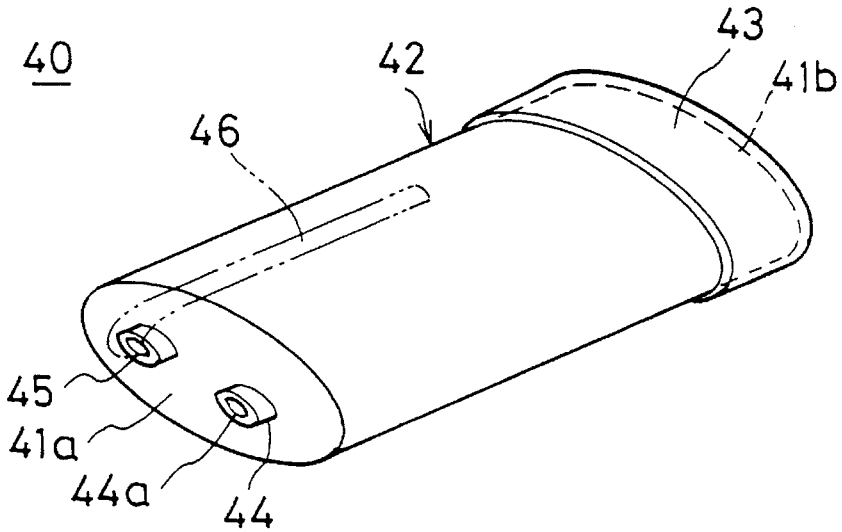
FIG. 10 is a perspective view of the container in Embodiment 4 according to the present invention.

FIG. 10 illustrates the fourth embodiment according to the present invention. A container 40 in this embodiment is composed of a barrel type cylindrical container main body 42 having an elliptic section one end of which is a base 41*a* and the other end of which is an opening 41*b*, and a cover 43 assembled to the opening 4l*b* of the container main body 42. The base 41*a* has an air suction opening 44 and an air discharge opening 45, and the air suction opening 44 has a check valve 44*a*.

In this embodiment, the container main body 42 is made from a material elastically deformable in the direction cutting the axial direction at right angles. Accordingly, the container main body 42 can be crushed, and when the force is removed in the crushed state, the container main body 42 returns to the shape illustrated in the drawing. A separately formed nozzle 46 can be placed removably in the discharge opening 45.

Things to be contained can be taken in and out of the container 40 in this embodiment by opening and closing the cover 43. When the container is used as an air pump, the inside is emptied and the nozzle 46 is assembled to the discharge opening 45. In this state, the container main body 42 is crushed repeatedly.

The container 40 in this embodiment is advantageous in that the pumping operation is easy and it has a fine appearance.

The suction opening and the discharge opening can be formed on the cover 43. Furthermore, it is possible to make more than one suction openings and discharge openings. And the nozzle 46 can be formed monolithically with the discharge opening 45. The check valve assembled to the suction opening can be omitted. In this case, the suction opening can be sealed by a finger and so on in pumping.

EMBODIMENT 5

Figure 11:
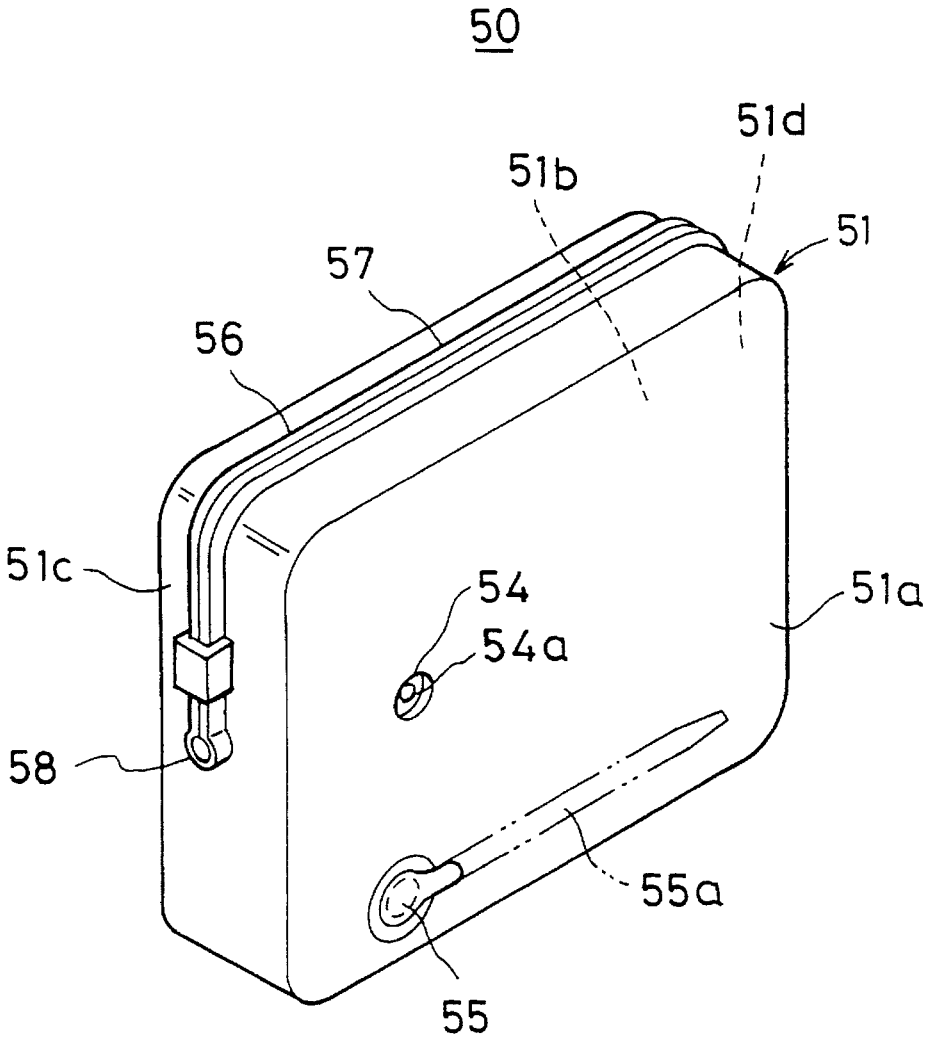
FIG. 11 is a perspective view of the container in Embodiment 5 according to the present invention.

FIG. 11 illustrates the fifth embodiment according to the present invention. A container 50 in this embodiment is composed of a container main body 51 of a rectangular parallelopiped shape as a whole. The container main body 51 is made from an elastic material. A side 51*a* of the container main body 51 has a suction opening 54 and a discharge opening 55. The suction opening 54 has a check valve 54*a*. An aperture 56 is formed from a top 51*b* of the container main body 51 to both sides 51*c* and 51*d* adjacent to the top, and the aperture 56 can be opened and closed with a slide fastener 57. When the aperture is closed, the airtight condition can be secured. A nozzle 55*a* can be placed removably in the discharge opening 55.

Things to be contained can be taken in and out of the container 50 in this embodiment through the aperture 56. By emptying the inside and closing the aperture 56 with the fastener 57 and then pushing in the side 51*a*, an air is discharged from the inside through the discharge opening 55. When the push is stopped, the side 51*a* returns to the original shape by the elastic force, when an air is sucked to the inside through the suction opening 54.

If a venting hole 58 maintained in an open condition is formed at one end of the aperture 56, as shown in the drawing, there is no need to set up the suction opening 54 separately.

EMBODIMENT 6

Figure 12:
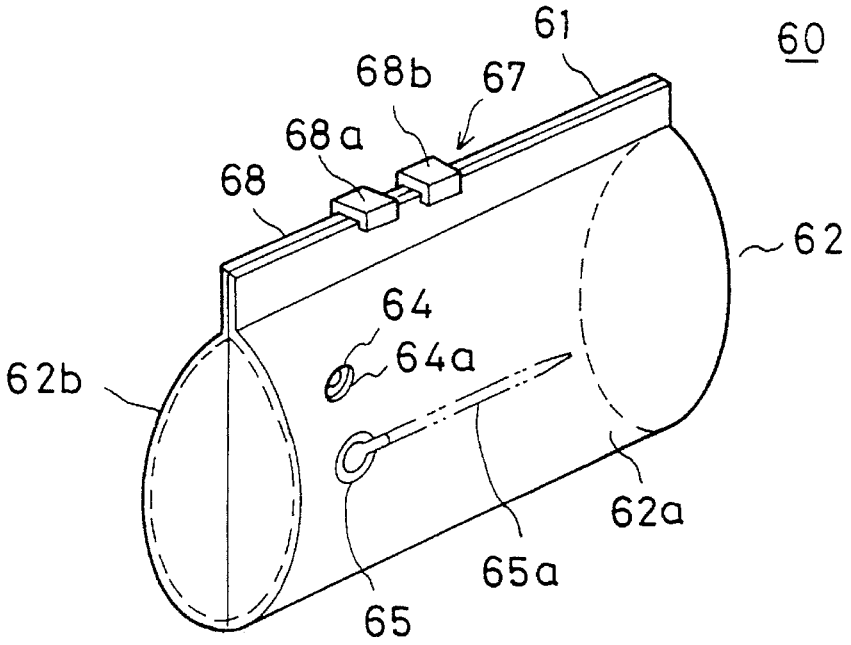
FIG. 12 is a perspective view of the container in Embodiment 6 according to the present invention.
Figure 13:
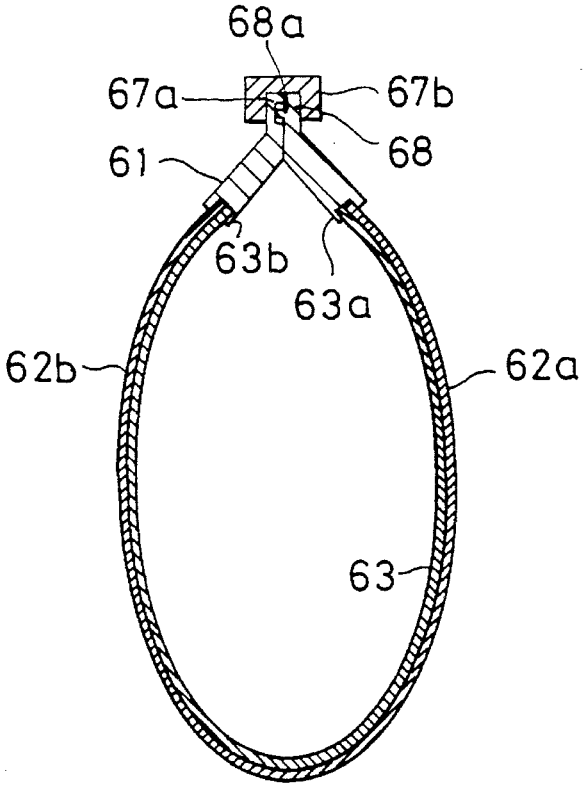
FIG. 13 is a cross section of the container in FIG. 12.

FIGS. 12 and 13 illustrate the sixth embodiment according to the present invention. A container 60 in this embodiment has a bag-shaped container main body 62 in which an opening and closing portion 61 is formed along a side edge portion spreading in the longer direction in an approximately rectangular shape from a flexible synthetic resin and so on. One leaf spring 63 made from elastic rigid synthetic resin is assembled along a front 62*a* and a back 62*b* of the container main body 62. Both edges 63*a* and 63*b* of the leaf spring 63 are set up along the inside edge portion of the opening and closing portion 61. This makes the container main body 62 flexed in a barrel shape as a whole.

If a force bigger than the elastic force of the leaf spring 63 is applied to the front 62*a* or the back 62*b* of the container main body 62, the front or the back caves in, and if the force is removed, the front or the back returns to the original shape.

The opening and closing portion 61 has a slide fastener 67. The slide fastener 67 is composed of a pair of engaging elements 67*a* and 67*b* the concave and the convex of which fit each other inside the opening and closing portion 61, and two sliders 68*a* and 68*b* moving along a guide 68 formed in the longer direction of the opening and closing portion 61. The fastener having this constitution opens or closes the opening and closing portion 61, and when the opening and closing portion is closed, it is possible to substantially seal the opening and closing portion 61.

The front 62*a* of the container main body 62 has a suction opening 64 and a discharge opening 65, and the suction opening 64 has a check valve 64*a*. The discharge opening 65 has a removable nozzle 65*a* separately formed.

The container 60 in this embodiment can be employed as a portable container by opening or closing the opening and closing portion 61. When the container is used as an air pump, the front or the back is indented repeatedly with the opening and closing portion 61 sealed. The pumping operation is the same as in the before-mentioned embodiments.

EMBODIMENT 7

Figure 14:
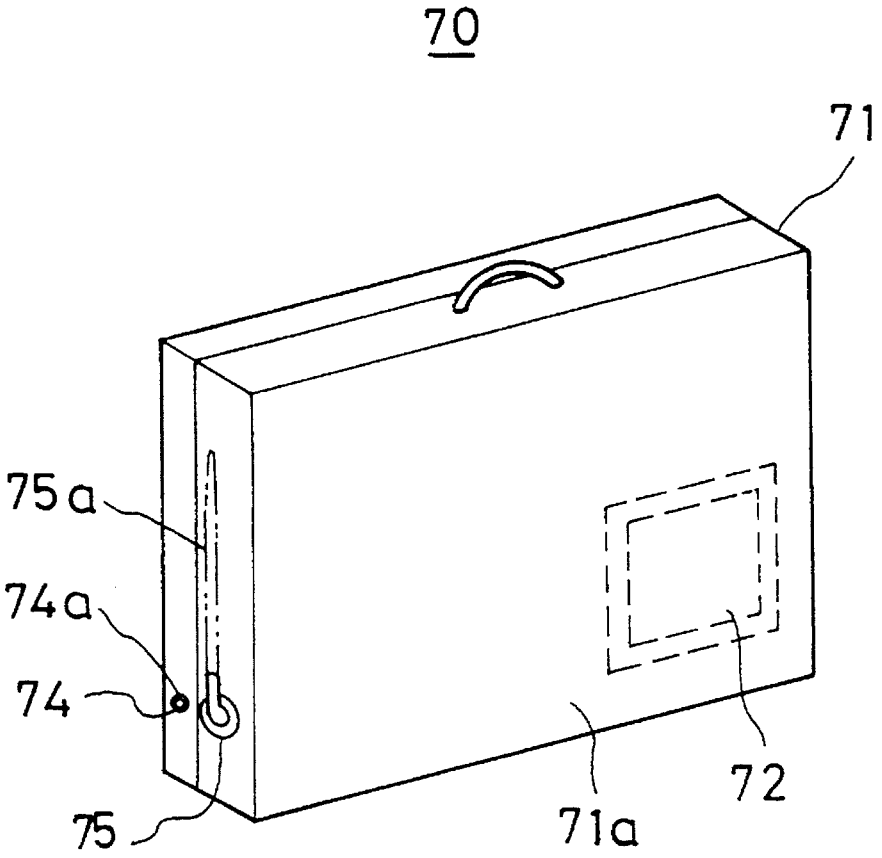
FIG. 14 is a perspective view of the container in Embodiment 7 according to the present invention.

FIG. 14 illustrates the seventh embodiment according to the present invention. A container 70 in this embodiment is composed of a container 71 of a rectangular parallelopiped shape as a whole. The container 71 can be opened and closed right and left as a dispatch case. A side 71*a* of the container 71 has an elastic portion 72 deformable in the direction cutting the face at right angles. And another side 71*b* of the container 71 has suction opening 74 to which a check valve 74*a* is assembled and a discharge opening 75. The discharge opening 75 has a removable nozzle 75*a*.

The container 70 in this embodiment, as in the before-mentioned embodiments, can be employed as a container or as an air pump.

I claim:

1. A combined housing and air pump, comprising:

an outer vessel having an inner surface, a closed end, and an open end;

an inner vessel having an outer surface, a closed end, and an open end;

an air suction opening and an air discharge opening that are formed on the closed end of one of the outer vessel and the inner vessel; and said inner vessel outer surface having an outside size and shape that correspond and are substantially very close to the inside size and shape of the outer vessel inner surface so that the inner vessel fits slidably axially within the outer vessel with a sealing effect;

wherein said air suction opening and said air discharge opening are formed on the closed end of said outer vessel, said inner vessel is insertable into said outer vessel from the opening end, and further comprising a cover which can removably close the open end of said outer vessel.

2. The combined housing and air pump according to claim 1, wherein said air suction opening has a check valve through which air is allowed to pass only in an air suction direction.

3. The combined housing and air pump according to claim 1, having an air discharge nozzle in addition, wherein the air discharge nozzle is assembled removably to said air discharge opening.

4. The combined housing and air pump of claim 1, wherein said outer and inner vessels are substantially cylindrical in shape.

5. A combined housing and air pump, comprising:

an outer vessel having an inner surface, a closed end, and an open end;

an inner vessel having an outer surface, a closed end, and an open end;

an air suction opening and an air discharge opening that are formed on the closed end of one of the outer vessel and the inner vessel;

said inner vessel outer surface having an outside size and shape that correspond and are substantially very close to the inside size and shape of the outer vessel inner surface so that the inner vessel fits slidably axially within the outer vessel with a sealing effect; and a cover for the open end of the inner vessel, wherein the inner vessel forms the housing.

6. The combined housing and air pump according to claim 5, wherein said air suction opening has a check valve through which air is allowed to pass only in an air suction direction.

7. The combined housing and air pump according to claim 5, having an air discharge nozzle in addition, wherein the air discharge nozzle is assembled removably to said air discharge opening.

8. The combined housing and air pump of claim 5, wherein the cover also fits over the open end of the outer vessel.

9. The combined housing and air pump of claim 5, wherein said outer and inner vessels are substantially cylindrical in shape.

* * * * *